US007528546B2

(12) United States Patent
Kwon et al.

(10) Patent No.: US 7,528,546 B2
(45) Date of Patent: May 5, 2009

(54) PLASMA DISPLAY PANEL HAVING IMPROVED LUMINOUS EFFICIENCY AND INCREASED DISCHARGE UNIFORMITY

(75) Inventors: Jae-Ik Kwon, Suwon-si (KR); Kyoung-Doo Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 334 days.

(21) Appl. No.: 11/390,057

(22) Filed: Mar. 28, 2006

(65) Prior Publication Data

US 2006/0255729 A1 Nov. 16, 2006

(30) Foreign Application Priority Data

May 16, 2005 (KR) ..... 10-2005-0040525

(51) Int. Cl.
*H01J 17/49* (2006.01)

(52) U.S. Cl. ..... 313/582; 313/583

(58) Field of Classification Search ..... 313/582–587
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |

(Continued)

FOREIGN PATENT DOCUMENTS

EP 1528588 5/2005

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Joseph L Williams
(74) *Attorney, Agent, or Firm*—Robert E. Bushnell, Esq.

(57) ABSTRACT

A plasma display panel having an increased aperture ratio which improves luminous efficiency, and having increased discharge uniformity in a discharge space enhancing luminance, is composed of: a front substrate and a rear substrate separated from each other; barrier ribs interposed between the front substrate and the rear substrate to partition discharge cells; discharge electrodes separated from each other and disposed between the front substrate and the rear substrate to generate a discharge; and fluorescent layers formed in the discharge cells. Two or more discharge spaces are formed in each of the discharge cells. Since two or more discharge cells are formed in one discharge cell, discharge uniformity is increased in a discharge space, thereby improving luminance.

29 Claims, 8 Drawing Sheets

U.S. PATENT DOCUMENTS

| | | | |
|---|---|---|---|
| 2002/0145387 | A1 | 10/2002 | Akiba |
| 2004/0113553 | A1 | 6/2004 | Yoon |

FOREIGN PATENT DOCUMENTS

| | | |
|---|---|---|
| EP | 1592039 | 11/2005 |
| EP | 1737016 | 12/2006 |
| JP | 06-267430 | 9/1994 |
| JP | 2845183 | 10/1998 |
| JP | 2917279 | 4/1999 |
| JP | 2000-133143 | 5/2000 |
| JP | 2000-331615 | 11/2000 |
| JP | 2001-043804 | 2/2001 |
| JP | 2001-325888 | 11/2001 |
| JP | 2004-206977 | 7/2004 |
| JP | 2004235042 | 8/2004 |
| WO | WO 02/054438 | 7/2002 |

OTHER PUBLICATIONS

*Search Report* from the European Patent Office issued in Applicant's corresponding European Patent Application No. 06-113969.7 dated Mar. 27, 2008.

European Search Report for European Application No. 06113969.7, dated Oct. 19, 2006.

Korean Office Action for Korean Patent Application No. 2005-0040525 issued on Aug. 31, 2006.

*Office action* from the Japanese Patent Office issued in Applicant's corresponding Japanese Patent Application No. 2006-114864 dated Nov. 18, 2008.

PLASMA DISPLAY PANEL HAVING IMPROVED LUMINOUS EFFICIENCY AND INCREASED DISCHARGE UNIFORMITY

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on the 16$^{th}$ of May 2005 and there, duly assigned Ser. No. 10-2005-0040525.

BACKGROUND OF THE INVENTION

1. Technical Field

The present invention relates to a plasma display panel, and more particularly, to a plasma display panel with an increased aperture ratio which improves luminous efficiency, and with increased discharge uniformity in a discharge space, thereby enhancing luminance.

2. Related Art

The plasma display device is a flat panel display device which includes a plasma display panel (PDP), and is expected to be the next generation of large flat panel display devices due to its large screen size. The PDP includes two substrates forming a space therebetween, into which an electric discharge gas is injected, and a plurality of electrodes which are formed between the two opposing substrates and to which a voltage is applied to generate a discharge. In addition, a fluorescent substance with a predetermined pattern is excited by ultraviolet rays generated due to the discharge so that a desired image is displayed on the PDP.

The plasma display panel includes a rear substrate and a front substrate which are disposed opposite to each other. Address electrodes are disposed on a surface of the rear substrate, and a first dielectric layer covers the address electrodes. Barrier ribs formed on the first dielectric layer define discharge cells in a matrix pattern. Each of discharge cells is coated with a fluorescent layer of a predetermined thickness.

The front substrate is a transparent substrate, such as a glass substrate, through which visible rays can permeate, and is coupled with the rear substrate on which the barrier ribs are formed. Pairs of sustain electrodes are formed on a back surface of the front substrate so as to intersect the address electrodes. The pairs of sustain electrodes include X electrodes and Y electrodes, respectively. A transparent second dielectric layer covers the pairs of sustain electrodes, and a protective layer is formed on a back surface of the second dielectric layer.

The plasma display panel includes a plurality of display pixels, and each of the display pixels is formed by a red, green or blue discharge cell according to a fluorescent substance which forms the fluorescent layer. Also, the plasma display panel represents a gray scale by manipulating discharge states of each of the discharge cells.

About 40% of the visible rays radiated from the fluorescent layer are absorbed by the sustain electrodes disposed on the back surface of the front substrate, the second dielectric layer covering the sustain electrodes, and the protective layer, and thus the luminous efficiency of the plasma display panel is low.

Furthermore, when the typical three-electrode surface discharge type plasma display panel displays the same image for a long time, the fluorescent layer is ion-sputtered by charged particles of the discharge gas, resulting in permanent image retention.

SUMMARY OF THE INVENTION

The present invention provides a plasma display panel in which two or more luminous areas are formed in a discharge cell to increase discharge uniformity in the discharge cell, thereby enhancing luminance.

According to an aspect of the present invention, the plasma display panel comprises: a front substrate and a rear substrate separated from each other; barrier ribs interposed between the front substrate and the rear substrate to partition discharge cells; discharge electrodes separated from each other between the front substrate and the rear substrate to generate a discharge; and fluorescent layers formed in the discharge cells; wherein two or more discharge spaces are formed in each of the discharge cells.

The barrier ribs may include front barrier ribs formed on the front substrate and facing the rear substrate and rear barrier ribs formed on the rear substrate and facing the front substrate.

The front barrier ribs may include horizontal front barrier ribs parallel to the front and rear discharge electrodes, and vertical front barrier ribs perpendicular to the front and rear discharge electrodes.

The rear barrier ribs may include horizontal rear barrier ribs parallel to the horizontal front barrier ribs, and vertical rear barrier ribs parallel to the vertical front barrier ribs.

The plasma display panel may further comprise separation horizontal front barrier ribs disposed between adjacent horizontal front barrier ribs, the horizontal front barrier ribs being formed on the horizontal rear barrier ribs.

A pair of the front discharge electrodes and a pair of the rear discharge electrodes may be disposed in each of the horizontal front barrier ribs to generate a discharge in the discharge cells adjacent to the discharge electrodes.

Two or more of the separation horizontal barrier ribs may be formed in each of the discharge cells.

According to another aspect of the present invention, a plasma display panel comprises: a front substrate and a rear substrate separated from each other; barrier ribs interposed between the front substrate and the rear substrate to define discharge cells, and including horizontal barrier ribs extending in one direction and vertical barrier ribs perpendicular to the horizontal barrier ribs; sustain electrode pairs interposed between the front substrate and the rear substrate, and spaced apart in a direction from the front substrate to the rear substrate inside of the horizontal barrier ribs so as to generate a discharge, and including front discharge electrodes and rear discharge electrodes extending parallel to each other; and fluorescent layers formed in each of the discharge cells; wherein two or more discharge spaces are formed in each of the discharge cells.

The plasma display panel may further comprise separation horizontal barrier ribs formed between adjacent horizontal barrier ribs, wherein at least one of the sustain electrode pairs is formed in each of the separation horizontal barrier ribs.

Two or more of the separation horizontal barrier ribs may be formed between the adjacent horizontal barrier ribs.

One of the sustain electrode pairs may be disposed in each of the separation horizontal barrier ribs.

Since two or more discharge spaces are formed in one discharge cell, discharge uniformity is increased in the discharge space, thereby improving luminance.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
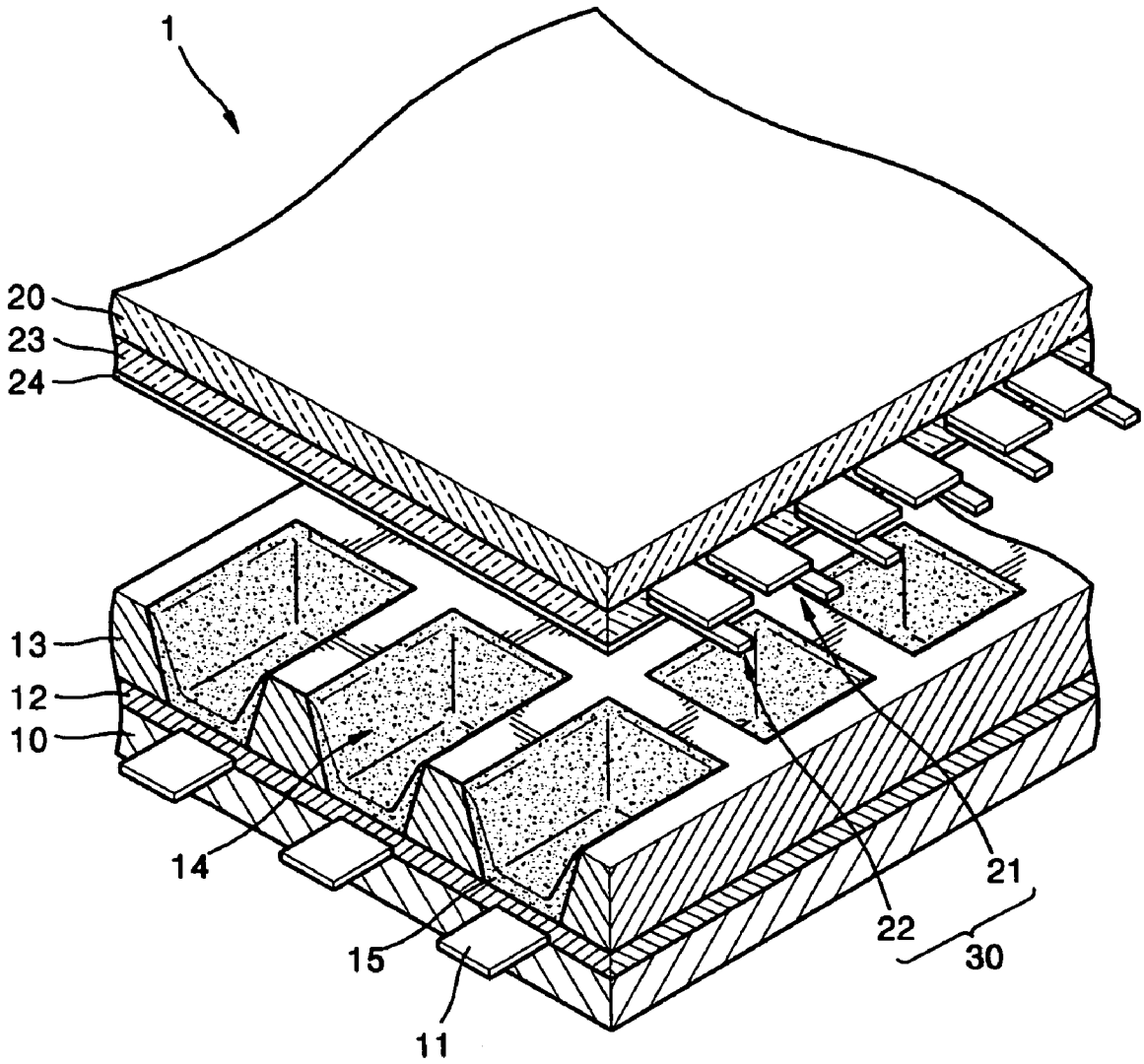
FIG. 1 is an exploded oblique view of a three-electrode surface discharge type plasma display panel.

FIG. 1 is an exploded oblique view of a three-electrode surface discharge type plasma display panel 1.

Referring to FIG. 1, the plasma display panel 1 includes a rear substrate 10 and a front substrate 20 which are opposite to each other. Address electrodes 11 are disposed on a surface of the rear substrate 10, and a first dielectric layer 12 covers the address electrodes 11. Barrier ribs 13 formed on the first dielectric layer 12 define discharge cells 14 in a matrix pattern. Each of discharge cells 14 is coated with a fluorescent layer 15 of a predetermined thickness.

The front substrate 20 is a transparent substrate, such as a glass substrate, through which visible rays can permeate, and is coupled with the rear substrate 10 on which the barrier ribs 13 are formed. Pairs of sustain electrodes 30 are formed on a back surface of the front substrate 20 so as to intersect the address electrodes 11. The pairs of sustain electrodes 30 include X electrodes 21 and Y electrodes 22, respectively. A transparent second dielectric layer 23 covers the pairs of sustain electrodes 30, and a protective layer 24 is formed on a back surface of the second dielectric layer 23.

The plasma display panel 1 includes a plurality of display pixels, and each of the display pixels is formed by a red, green or blue discharge cell according to a fluorescent substance which forms the fluorescent layer 15. Also, the plasma display panel 1 represents a gray scale by manipulating discharge states of each of the discharge cells 14.

About 40% of the visible rays radiated from the fluorescent layer 15 are absorbed by the sustain electrodes 21 and 22 disposed on the back surface of the front substrate 20, the second dielectric layer 23 covering the sustain electrodes 21 and 22, and the protective layer 24, and thus the luminous efficiency of the plasma display panel 1 is low.

Furthermore, when the typical three-electrode surface discharge type plasma display panel 1 displays the same image for a long time, the fluorescent layer 15 is ion-sputtered by charged particles of the discharge gas, resulting in permanent image retention.

Figure 2:
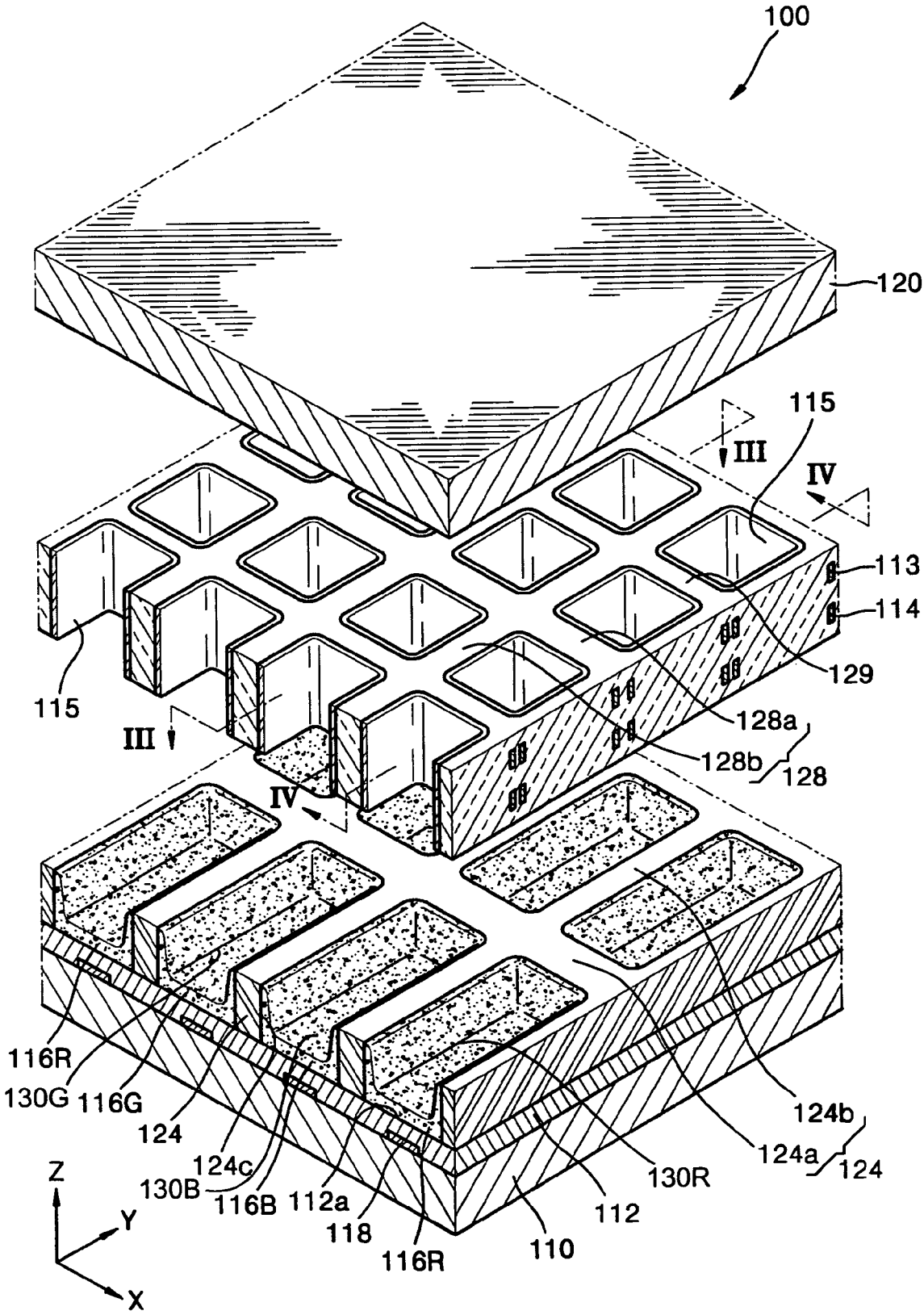
FIG. 2 is an exploded oblique view of a plasma display panel according to an embodiment of the present invention.
Figure 3:
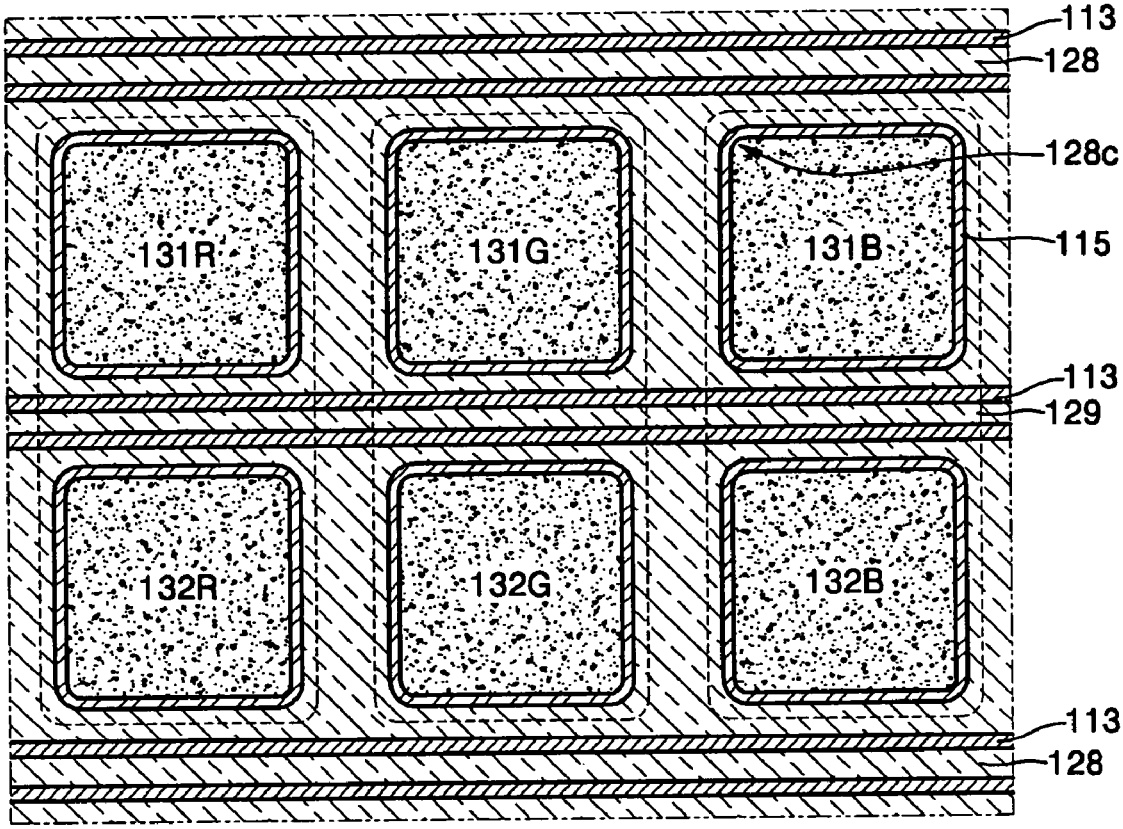
FIG. 3 is a cross-section view taken along section line III-III in FIG. 2.
Figure 4:
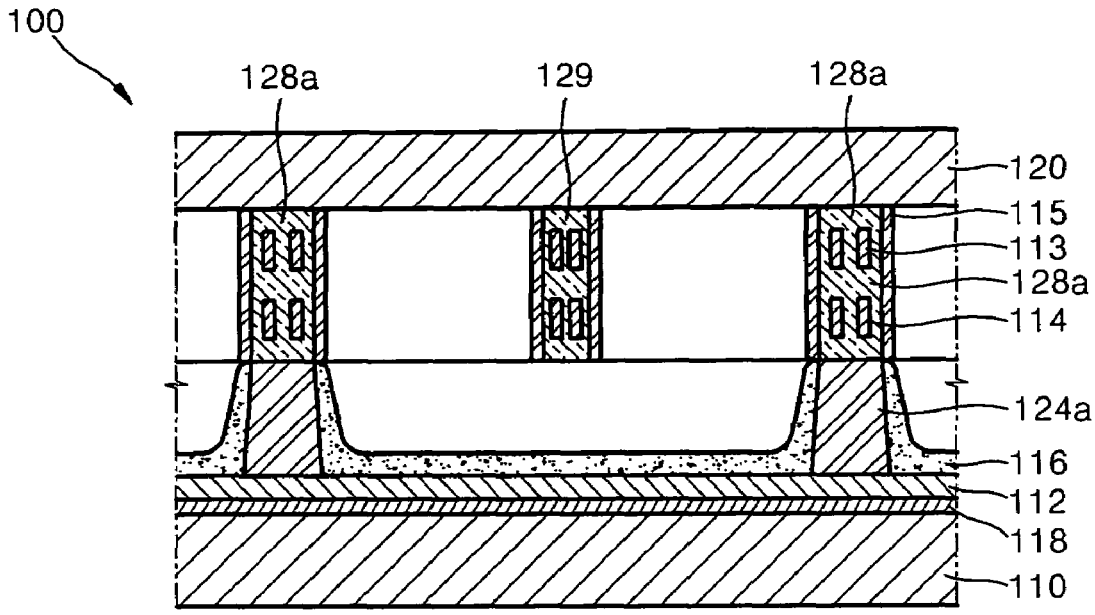
FIG. 4 is a cross-section view taken along section line IV-IV in FIG. 2.

FIG. 2 is an exploded oblique view of a plasma display panel according to an embodiment of the present invention, FIG. 3 is a cross-section view taken along section line III-III in FIG. 2, and FIG. 4 is a cross-section view taken along section line IV-IV in FIG. 2.

Referring to FIGS. 2 thru 4, the plasma display panel 100 includes a front substrate 120, a rear substrate 110, front and rear barrier ribs 128 and 124, respectively, front and rear discharge electrodes 113 and 114, respectively, address electrodes 118, and fluorescent layers 116R, 116G and 116B.

The front substrate 120 and the rear substrate 110 are disposed a predetermined distance apart from each other. The front and rear barrier ribs 128 and 124, respectively, which are interposed between the front substrate 120 and the rear substrate 110 to define discharge cells 130R, 130G and 130B, are made of a dielectric.

The discharge electrodes 113 and 114 are interposed between the front substrate 120 and the rear substrate 110 and are a predetermined distance apart from each other, and a power voltage is applied to the discharge electrodes 113 and 114 so that a discharge occurs in discharge spaces respectively formed in the discharge cells 130R, 130G and 130B. The fluorescent layers 116R, 116G and 116B are formed in the discharge cells 130R, 130G and 130B, respectively. The discharge cells 130R, 130G and 130B are injected with a discharge gas.

In particular, two or more discharge spaces are formed in each of the discharge cells 130R, 130G and 130B of the plasma display panel 100 according to the present embodiment.

The front barrier ribs 128 are formed on the front substrate 120 and face the rear substrate 110, and the rear barrier ribs 124 are formed on the rear substrate 110 and face the front substrate 120. An MgO protective layer 115 is deposited on surfaces of the front barrier ribs 128 defining the discharge cells.

The front discharge electrodes 113 and the rear discharge electrodes 114 are parallel to and separated from each other, and extend from the front substrate 120 toward the rear substrate 110. The front and rear discharge electrodes 113 and 114, respectively, may be formed inside the front and/or rear barrier ribs 128 and/or 124, respectively, and in the present embodiment, the front and rear discharge electrodes 113 and 114, respectively, are inside the front barrier ribs 128.

The address electrodes 118 may intersect the front and rear discharge electrodes 113 and 114, respectively. The address electrodes 118 are formed on the rear substrate 110, and a dielectric layer 112 is formed on the rear substrate 110 to cover the address electrodes 118.

The front barrier ribs 128 include a horizontal front barrier ribs 128*a* extending in a direction X and vertical front barrier ribs 128*b* extending in a direction Y. The front and rear discharge electrodes 113 and 114, respectively, may be formed inside the horizontal front barrier rib 128*a* extending in the direction X.

The rear barrier ribs 124 include horizontal rear barrier ribs 124*a* parallel to the horizontal front barrier ribs 128*a* and vertical rear barrier ribs 124*b* parallel to the vertical front barrier ribs 128*b*. The horizontal front barrier ribs 128*a* are disposed on the horizontal rear barrier ribs 124*a* and the vertical front barrier ribs 128*b* are disposed on the vertical rear barrier ribs 124*b* to form discharge cells 130R, 130G and 130B.

The plasma display panel 100 includes a plurality of display pixels, and each of the display pixels is formed by one of the red, green and blue discharge cells 130R, 130G and 130B, respectively, according to fluorescent substances that form fluorescent layers 116R, 116G and 116B, respectively. Also, the plasma display panel 100 provides a gray scale by manipulating discharge states of the individual discharge cells 130R, 130G and 130B.

Additionally, separation horizontal front barrier ribs 129 are formed between the horizontal front barrier ribs 128*a* that define the discharge cells 130R, 130G and 130B, and thus two or more discharge spaces are formed in each of the discharge cells 130R, 130G and 130B. Specifically, the separation horizontal front barrier ribs 129 are formed between adjacent horizontal front barrier ribs 128*a* in a space defined by the horizontal rear barrier ribs 124*a* and the horizontal front barrier ribs 128*a*.

Two or more separation horizontal barrier ribs 129 may be disposed between the opposing horizontal front barrier ribs 128*a*. The width of the separation horizontal front barrier ribs 129 may be sufficiently narrow to maximize the discharge space inside the discharge cells 130R, 130G and 130B.

A pair of the front discharge electrodes 113 and a pair of the rear discharge electrodes 114 may be disposed in each of the horizontal front barrier ribs 128*a* to generate a discharge in both discharge cells adjacent to the horizontal front barrier ribs 128*a*. Also, a pair of the front discharge electrodes 113 and a pair of the rear discharge electrodes 114 may be disposed in each of the separation horizontal front barrier ribs 129 as shown in drawings.

Referring to FIG. 3, one red discharge cell includes two discharge spaces 131R and 132R which are divided by the separation horizontal barrier rib 129, and the two discharge spaces may be displayed as the same discharge cell. In the same fashion, one green discharge cell includes two discharge spaces 131G and 132G which are divided by the separation horizontal barrier rib 129, and one blue discharge cell includes two discharge spaces 131B and 132B, which are also divided by the separation horizontal barrier rib 129.

Accordingly, a discharge can occur uniformly in the entire discharge space inside each of the discharge cells, and thus luminance and luminous efficiency can be improved. Specifically, when the shape of the interior of the discharge cell extends in one direction, that is, the direction Y, the discharge can occur uniformly.

The structure of the discharge cell into two discharge spaces is not limited to the present embodiment, and a variety of structures can be used.

The rear substrate 110 and the front substrate 120 are located parallel to and a predetermined distance from each other, and define a plurality of red, green, and blue discharge cells 130R, 130G and 130B with the front barrier ribs 128 interposed therebetween. In the present embodiment, since visible rays emitted from the discharge cells 130R, 130G and 130B are transmitted to the exterior through the front substrate, the front substrate 120 is made of a material with high light permeability, such as glass. The rear substrate 110 can also be made of glass. However, the present invention is not limited to displaying an image through the front substrate 120, and may display an image through the rear substrate 110, or through both front and rear substrates 120 and 110, respectively.

The front barrier ribs 128 are arranged in a matrix pattern, and partition a plurality of discharge cells 130R, 130G and 130B, each of which has a rectangular cross-section. Particularly, in the present embodiment, the corners of the front barrier ribs 128*c* are rounded to prevent a discharge from being concentrated in the corners 128*c*, which causes damage to the front barrier rib 128, and to generate the discharge uniformly in the discharge space. However, the pattern of the front barrier ribs 128 is not limited to a matrix pattern, and the front barrier ribs 128 may have a variety of patterns, such as a waffle pattern and a delta pattern, as long as a plurality of discharge spaces can be formed. Additionally, the discharge cells may be formed such that their cross-sections are polygonal, such as triangular or pentagonal, circular, and oval.

The front substrate 120 and the front barrier ribs 128 may be integrally formed such that they are fixed to each other. Therefore, the front substrate 120 and the front barrier ribs 128 cannot be easily separated from each other without breaking them.

Since the front discharge electrodes 113 and the rear discharge electrodes 114 do not reduce transmittance of visible rays advancing toward the front substrate 120 (in the direction Z), the front and rear discharge electrodes 113 and 114 can be made of a conductive metal, such as aluminum, copper, or the like. Thus, voltage sag is small, and therefore, stable signal transmission is possible.

The front barrier ribs 128 may be made of a dielectric which can prevent a leakage current between the front discharge electrode 113 and the rear discharge electrode 114, and damage to the front discharge electrode 113 and the rear discharge electrode 114 due to positive ions or electrons colliding with the front and rear discharge electrode 113 and 114, respectively, and can accumulate wall charge due to induced charges.

The address electrodes 118 extend on the rear substrate 110 and intersect the discharge cells 130R, 130G and 130B with a predetermined distance between each other. The address electrodes 118 extend perpendicularly (in a direction Y) to the direction in which the front and rear discharge electrodes 113 and 114, respectively, extend. The address electrodes 118 generate an address discharge to facilitate a sustain discharge between the front discharge electrodes 118 and the rear discharge electrodes 114, and lower a voltage for initializing the sustain discharge in a discharge cell in which an image is to be displayed.

An address discharge occurs between a scanning electrode and the address electrode 118. After the address discharge is terminated, positive ions are accumulated on the scanning electrode and electrons are accumulated on a common electrode, and thus, a sustain discharge between the scanning electrode and the common electrode occurs more easily. Since the address discharge occurs easily when the distance between the scanning electrode and the address electrode is narrow, the rear discharge electrodes 114 close to the address electrodes 118 may act as scanning electrodes and the front discharge electrodes 113 may act as common electrodes.

However, the arrangement of the electrodes of embodiments of the present invention are not limited to those described above. For example, the address electrodes 118 may be disposed in the front barrier ribs 128, or the front discharge electrodes 113, the address electrodes 118 and the rear discharge electrodes 114 may be disposed perpendicular to the front substrate 120 and may enclose the discharge cells 130R, 130G and 130B, which extend in the direction Y. In the present embodiment, either of the front and rear discharge electrodes 113 and 114, respectively, which are closest to the address electrodes 118 desirably act as scanning electrodes.

The address electrodes 118 may be covered with a dielectric layer 112. The dielectric layer 112 is made of a dielectric, such as PbO, $B_2O_3$, $SiO_2$ or the like, which can induce charge and can prevent damage to the address electrodes 118 by positive ions or electrons which collide with the address electrodes 118 during discharging.

The rear barrier ribs 124 are disposed between the dielectric layer 112 and the front barrier ribs 128 to partition the discharge cells 130R, 130G and 130B. Although, the rear barrier ribs 124 have the same shape as the front barrier ribs 128 in the present embodiment, they may have a shape different from that of the front barrier ribs 128.

In the present embodiment, sides 124*c* of the rear barrier ribs 124 and a top surface 112*a* of the dielectric layer 112 are coated with one of the red, green and blue fluorescent layers 116R, 116G and 116B, respectively, of a predetermined thickness. Specifically, sides of the rear barrier ribs 124 and the top surface of the dielectric layer 112 which define the red discharge cell 130R are coated with the red luminous fluorescent layer 116R, sides of the rear barrier ribs 124 and the top surface 112*a* of the dielectric layer 112 which define the green discharge cell 130B are coated with the green luminous fluorescent layer 116G, and sides of the rear barrier ribs 124 and the top surface 112*a* of the dielectric layer 112 which define the blue discharge cell 130B are coated with the blue luminous fluorescent layer 116B. Due to the red, green and blue luminous fluorescent layers 116R, 116G and 116B, respectively, coated on the sides of the rear barrier ribs 124 and the top surface 112*a* of the dielectric layer 112, the fluorescent layer coating area is increased.

The fluorescent layers 116R, 116G and 116B have components which receive ultraviolet rays and produce visible rays. The red luminous fluorescent layers 116R formed in the red discharge cells 130R include fluorescent substances such as $Y(V,P)O_4$:Eu, the green luminous fluorescent layers 116G formed in the green discharge cells 130G include fluorescent substances such as $Zn_2SiO_4$:Mn, and the blue luminous fluorescent layers 116B formed in the blue discharge cells 130G include fluorescent substances such as BAM:Eu.

A protective layer 115 is formed on each side of the front barrier ribs 128. The protective layers 115 prevent damage to the front barrier ribs 128, which are made of a dielectric, due to sputtering of plasma particles, lower discharge voltage by releasing secondary electrons during plasma discharge, and increase the size of discharge. The protective layer 115 is an MgO layer coated on the side of the front barrier rib 128 to a predetermined thickness. The protective layer 115 is a thin film formed by sputtering or an electronic beam evaporation method.

The discharge cells 130R, 130G and 130B are injected with a discharge gas such as Ne, Xe, or a mixed gas composed of Ne and Xe. In an embodiment of the present invention, since the discharging surface can be enlarged and the discharge region can be expanded to increase the amount of plasma formed, low-voltage driving is possible. Accordingly, low-voltage driving is possible even when a hyperbaric Xe gas is used as the discharge gas, and hence luminous efficiency is remarkably improved. Therefore, the problem of low-voltage driving being difficult when the hyperbaric Xe gas is used as a discharge gas in the conventional plasma display panel is resolved.

In the plasma display panel 100, the visible rays emitted from the fluorescent layers 116R, 116G and 116B permeate the front substrate 120 and proceed forward. Since the front discharge electrodes 113 and the rear discharge electrodes 114 disposed in the front barrier ribs 128 are not necessarily transparent, they can be made of conductive materials. Since the front discharge electrodes 113 and the rear discharge electrodes 114 can be made of metal materials, such as Ag, Al, or Cu, with high conductivity, the response speed for discharge is fast, the signal is not distorted, and power consumption for a sustain discharge can be reduced.

FIG. 4 illustrates pairs of front discharge electrodes 113 and pairs of rear discharge electrodes 114 formed in the separation horizontal front barrier ribs 129. The pairs of the front discharge electrodes 113 and the rear discharge electrodes 114 are for the discharge cells on either side of the pairs of front and rear discharge electrodes 113 and 114, respectively. The widths of the separation horizontal front barrier ribs 129 may be sufficiently small to maximize the discharge spaces inside each of the discharge cells.

Figure 5:
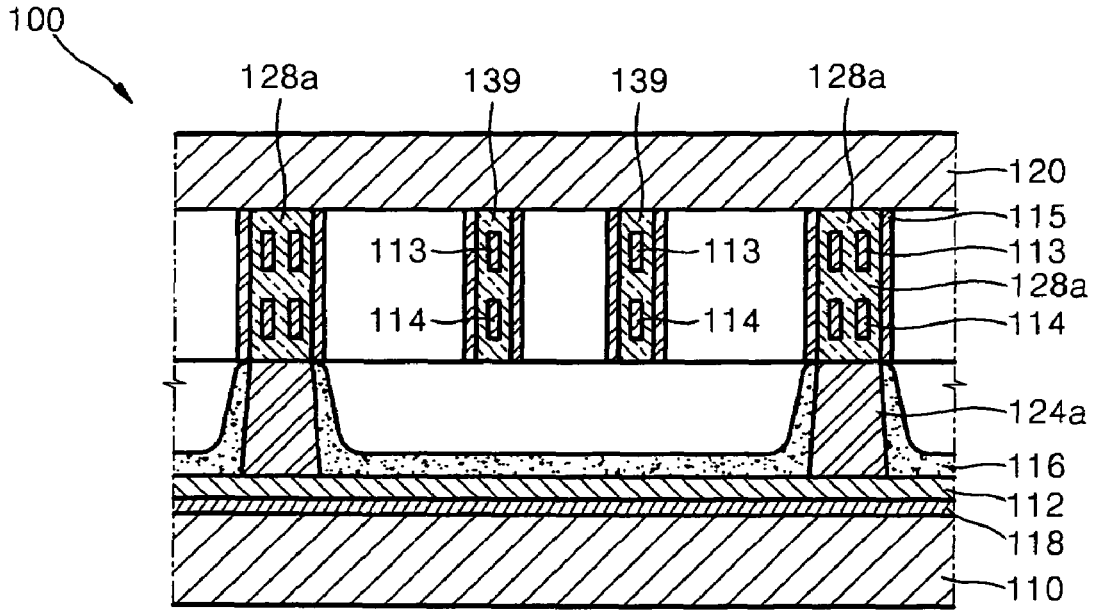
FIG. 5 is a cross-section view of a modification of the plasma display panel of FIG. 2 taken along section line IV-IV.
Figure 6:
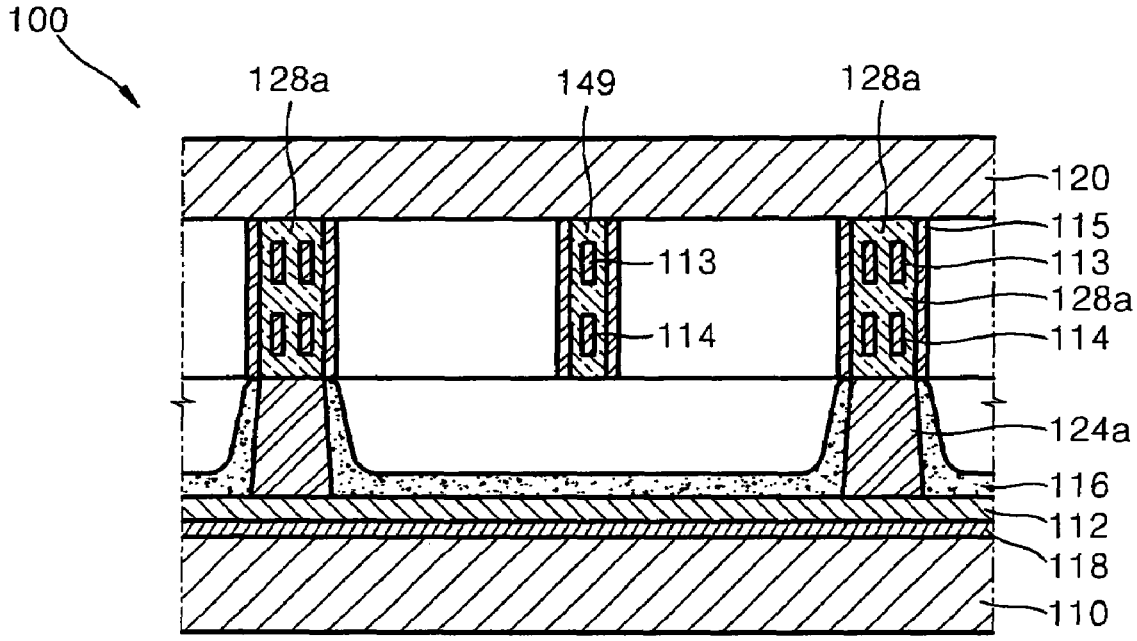
FIG. 6 is a cross-section view of a modification of the plasma display panel of FIG. 2 taken along section line IV-IV.

FIG. 5 is a cross-section view of a modification of the plasma display panel of FIG. 2 taken along section line IV-IV, and FIG. 6 is a cross-section view of a modification of the plasma display panel of FIG. 2 taken along section line IV-IV.

FIGS. 5 and 6 illustrate modifications of the plasma display panel 100 illustrated in FIG. 4. Referring to FIG. 5, two separation horizontal front barrier ribs 139 are formed between the horizontal front barrier ribs 128*a*, and one front discharge electrode 113 and one rear discharge electrode 114 are formed in each of the separation horizontal front barrier ribs 139. Accordingly, three discharge spaces are created in one discharge cell.

Referring to FIG. 6, a single horizontal front barrier rib 149 is formed between the horizontal front barrier ribs 128*a*, and one front discharge electrode 113 and one rear discharge electrode 114 are formed in the separation horizontal barrier rib 149. Thus, two discharge spaces are created in one discharge cell, and the front and rear discharge electrodes 113 and 114, respectively, are commonly used for both adjacent discharge spaces.

According to the present invention, in a plasma display panel, electrodes are not disposed on a front substrate through which visible rays travel, but on sides of a discharge cell, and thus the aperture ratio of the plasma display panel is increased, thereby improving luminous efficiency.

Additionally, an electric field resulting from a voltage applied to front and rear discharge electrodes formed in sides of a discharge cell concentrates plasma in the center of a discharge cell, thereby preventing ions generated during discharge from colliding with a fluorescent substance due to the electric field, even when discharge occurs for a long time. As a result, permanent image retention generated by damage to the fluorescent substance due to ion-sputtering can be prevented.

Figure 7:
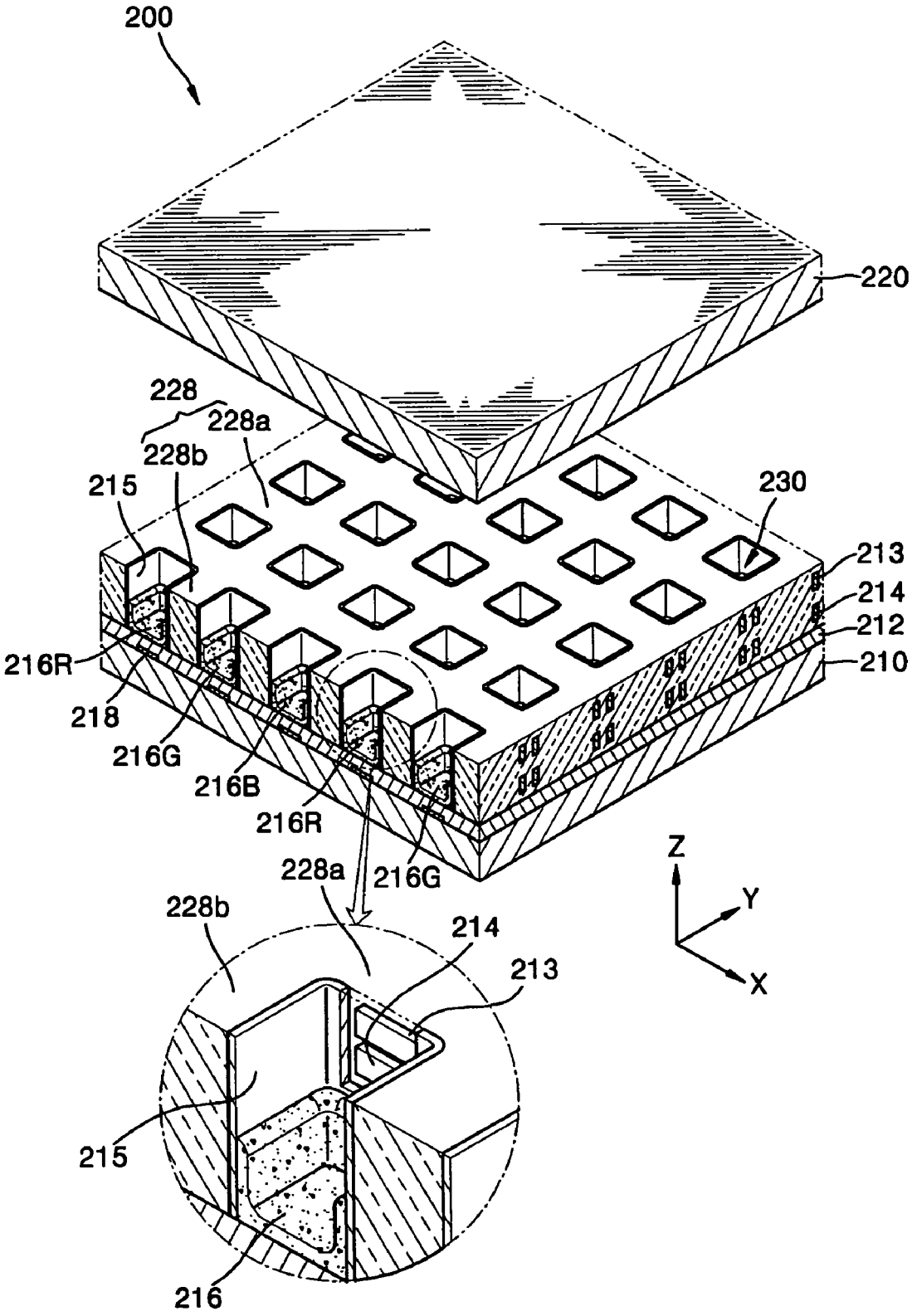
FIG. 7 is an exploded oblique view of a plasma display panel according to another embodiment of the present invention.
Figure 8:
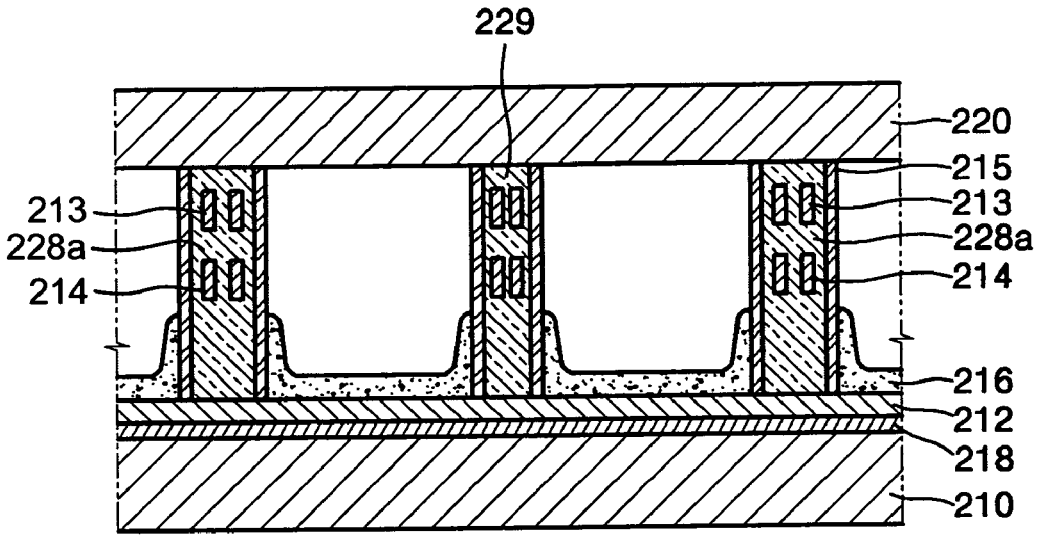
FIG. 8 is a cross-section view taken along section line VIII-VIII in FIG. 7.

FIG. 7 is an exploded oblique view of a plasma display panel according to another embodiment of the present invention. FIG. 8 is a cross-section view taken along section line VIII-VIII in FIG. 7.

Referring to FIGS. 7 and 8, the plasma display panel 200 includes the same structure as the plasma display panel 100 illustrated in FIGS. 2 thru 4 except as described below. Like reference numerals denote like elements in FIGS. 2 thru 8, and detailed descriptions of the like elements will not be repeated.

In the plasma display panel 200, barrier ribs 228 are integrally formed with a front substrate 220 and a rear substrate 210. A fluorescent layer 216 is formed on an inner bottom portion of a discharge cell 230 defined by the barrier ribs 228. In the present embodiment, address electrodes 218 are disposed on the rear substrate 210, a dielectric layer 212 covers the address electrodes 218, the barrier ribs 228 are disposed on the dielectric layer 212, and the fluorescent layer 216 is formed on lower sides of each of the barrier ribs 228 and a top surface of the dielectric layer 212, thus forming discharge cells 230.

In another embodiment of the present invention, the fluorescent layer 216 may be formed on the dielectric layer 212 and the barrier ribs 228 may be formed on the fluorescent layer 216 to form the discharge cells 230.

In FIG. 8, a pair of front discharge electrodes 213 and a pair of rear discharge electrodes 214 are formed in the barrier ribs

228*a* for the right and left discharge spaces next to the discharge electrodes 213 and 214.

Figure 9:
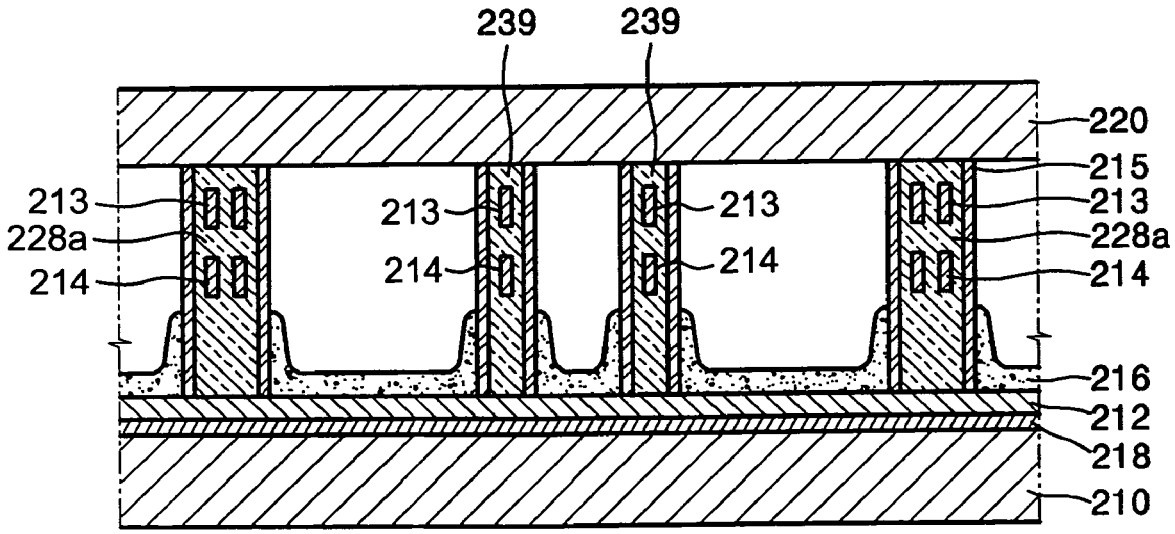
FIG. 9 is a cross-section view of a modification of the plasma display panel of FIG. 7 taken along section line VIII-VIII.
Figure 10:
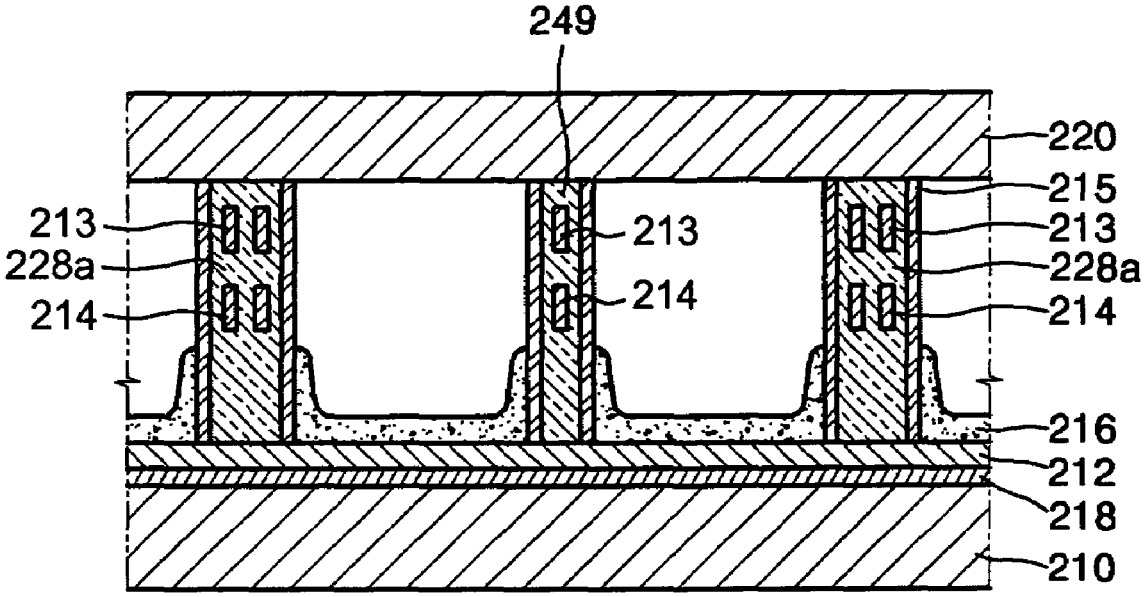
FIG. 10 is a cross-section view of a modification of the plasma display panel of FIG. 7 taken along section line VIII-VIII.

FIG. 9 is a cross-section view of a modification of the plasma display panel of FIG. 7 taken along section line VIII-VIII, and FIG. 10 is a cross-section view of a modification of the plasma display panel of FIG. 7 taken along section line VIII-VIII.

FIGS. 9 and 10 illustrate modifications of the plasma display panel 200. Referring to FIG. 9, two separation horizontal front barrier ribs 239 are formed between the horizontal front barrier ribs 228*a*, and one front discharge electrode 213 and one rear discharge electrode 214 are formed in each of the separation horizontal front barrier ribs 239. Accordingly, three discharge spaces are produced inside a discharge cell.

Referring to FIG. 10, one separation horizontal front barrier rib 249 is formed between the horizontal front barrier ribs 228*a*, and one front discharge electrode 213 and one rear discharge electrode 214 are formed in the separation horizontal front barrier rib 249. Thus, two discharge spaces are formed in one discharge cell, and the front and rear discharge electrodes 213 and 214 are used for both adjacent discharge spaces.

According to the present invention, two or more discharge spaces are formed in a discharge cell to increase discharge uniformity in the discharge space, thereby improving luminance.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A plasma display panel, comprising:

a front substrate and a rear substrate which are separated from each other;

barrier ribs interposed between the front substrate and the rear substrate to partition discharge cells;

discharge electrodes separated from each other and disposed between the front substrate and the rear substrate to generate a discharge; and fluorescent layers formed in the discharge cells;

wherein at least two discharge spaces are formed in each of the discharge cells;

wherein the barrier ribs completely separate the discharge cells from each other;

wherein each discharge cell corresponds to a display pixel;

wherein the discharge electrodes comprise front discharge electrodes and rear discharge electrodes, which are parallel to each other, and which are spaced apart in a direction extending from the front substrate to the rear substrate; and wherein the front discharge electrodes and the rear discharge electrodes are adapted to generate a separate discharge in each discharge space.

2. The plasma display panel of claim 1, wherein the discharge electrodes further comprise address electrodes which intersect the front discharge electrodes and the rear discharge electrodes.

3. The plasma display panel of claim 1, wherein the front discharge electrodes and the rear discharge electrodes are formed in the barrier ribs.

4. The plasma display panel of claim 1, wherein the barrier ribs are made of a dielectric.

5. The plasma display panel of claim 1, wherein the barrier ribs comprise front barrier ribs formed on the front substrate and facing the rear substrate, and rear barrier ribs formed on the rear substrate and facing the front substrate.

6. The plasma display panel of claim 5, wherein the front discharge electrodes and the rear discharge electrodes are formed in the front barrier ribs.

7. The plasma display panel of claim 5, further comprising an MgO protective layer formed on inner side surfaces of the front barrier ribs.

8. The plasma display panel of claim 5, wherein the front barrier ribs comprise horizontal front barrier ribs parallel to the front discharge electrodes and the rear discharge electrodes, and vertical front barrier ribs perpendicular to the front discharge electrodes and the rear discharge electrodes.

9. The plasma display panel of claim 8, wherein the rear barrier ribs comprise horizontal rear barrier ribs extending parallel to the horizontal front barrier ribs and vertical rear barrier ribs extending parallel to the vertical front barrier ribs.

10. The plasma display panel of claim 8, further comprising separation horizontal front barrier ribs disposed between the horizontal front barrier ribs, wherein the horizontal front barrier ribs are formed on the horizontal rear barrier ribs.

11. The plasma display panel of claim 10, wherein a pair of the front discharge electrodes and a pair of the rear discharge electrodes are disposed in each of the horizontal front barrier ribs to generate a discharge in the discharge cells adjacent to the front and rear discharge electrodes.

12. The plasma display panel of claim 11, wherein one of front discharge electrodes and one of rear discharge electrodes are disposed in each of the separation horizontal front barrier ribs.

13. The plasma display panel of claim 11, wherein a pair of the front discharge electrodes and a pair of the rear discharge electrodes are disposed in each of the separation horizontal front barrier ribs.

14. The plasma display panel of claim 10, wherein at least two of the separation horizontal barrier ribs are formed in each of the discharge cells.

15. The plasma display panel of claim 5, wherein the discharge electrodes further comprise address electrodes which intersect the front discharge electrodes and the rear discharge electrodes.

16. The plasma display panel of claim 15, wherein the address electrodes are formed on the rear substrate.

17. The plasma display panel of claim 16, further comprising a dielectric layer formed on the rear substrate to cover the address electrodes.

18. The plasma display panel of claim 5, wherein the fluorescent layers are formed on at least sides of each of the rear barrier ribs.

19. The plasma display panel of claim 5, wherein the front barrier ribs are separate from the rear barrier ribs.

20. The plasma display panel of claim 1, wherein each of the discharge cells is injected with a discharge gas.

21. A plasma display panel, comprising:

a front substrate and a rear substrate which are separated from each other;

barrier ribs which are interposed between the front substrate and the rear substrate to define discharge cells, and which include horizontal barrier ribs extending in one direction and vertical barrier ribs extending in a direction perpendicular to the one direction of the horizontal barrier ribs;

sustain electrode pairs which are interposed between the front substrate and the rear substrate, and which are spaced apart in a direction extending from the front substrate to the rear substrate inside of the horizontal barrier ribs so as to generate a discharge, and including front discharge electrodes and rear discharge electrodes extending parallel to each other; and fluorescent layers formed in each of the discharge cells;

wherein at least two discharge spaces are formed in each of the discharge cells;

said plasma display panel further comprising separation horizontal barrier ribs formed between adjacent horizontal barrier ribs, wherein at least one of the sustain electrode pairs is formed in each of the separation horizontal barrier ribs.

22. The plasma display panel of claim 21, wherein at least two of the separation horizontal barrier ribs are formed between adjacent said horizontal barrier ribs.

23. The plasma display panel of claim 21, wherein one of the sustain electrode pairs is disposed in each of the separation horizontal barrier ribs.

24. The plasma display panel of claim 21, wherein two of the pairs of sustain electrodes are formed in each of the separation horizontal barrier ribs.

25. The plasma display panel of claim 22, wherein the barrier ribs are made of a dielectric.

26. The plasma display panel of claim 21, further comprising address electrodes intersecting the front discharge electrodes and the rear discharge electrodes.

27. The plasma display panel of claim 26, further comprising a dielectric layer formed on the rear substrate to cover the address electrodes, wherein the address electrodes are formed on the rear substrate.

28. The plasma display panel of claim 21, wherein the fluorescent layers are formed on at least sides of each of the barrier ribs.

29. The plasma display panel of claim 21, wherein the discharge cells are injected with a discharge gas.

* * * * *